US006843665B2

(12) United States Patent
Motojima et al.

(10) Patent No.: US 6,843,665 B2
(45) Date of Patent: Jan. 18, 2005

(54) CONNECTOR IN WHICH CONTACT FORCE CAN BE MAINTAINED DURING A LONG PERIOD

(75) Inventors: Yuko Motojima, Akishima (JP); Hiroshi Akimoto, Ome (JP); Kazuhito Hisamatsu, Akiruno (JP); Masaaki Takaku, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/673,891

(22) Filed: Sep. 29, 2003

(65) Prior Publication Data

US 2004/0102067 A1 May 27, 2004

(30) Foreign Application Priority Data

Sep. 30, 2002 (JP) ..... 2002/286663

(51) Int. Cl.[7] ..... H01R 4/66
(52) U.S. Cl. ..... 439/108
(58) Field of Search ..... 439/79, 80, 108, 439/607, 608, 609, 610

(56) References Cited

U.S. PATENT DOCUMENTS 4,738,637 A 4/1988 Asick et al.
4,836,791 A * 6/1989 Grabbe et al. ..... 439/79
4,869,677 A * 9/1989 Johnson et al. ..... 439/80
5,356,313 A * 10/1994 Niwa et al. ..... 439/607
5,549,481 A 8/1996 Morlion et al.
5,618,191 A * 4/1997 Chikano et al. ..... 439/108
5,961,355 A * 10/1999 Morlion et al. ..... 439/686
6,056,600 A 5/2000 Watanabe et al.
6,322,395 B1 11/2001 Nishio et al.

FOREIGN PATENT DOCUMENTS

JP 2001 203047 7/2001

* cited by examiner

*Primary Examiner*—Thanh-Tam Le
(74) *Attorney, Agent, or Firm*—Collard & Roe, P.C.

(57) ABSTRACT

In a connector (10) for connecting a connection object (30), a conductive contact (11) is held by an insulator (12) and is for electrically connecting the connection object. In addition, a conductive plate (14) is held by the insulator. The conductive plate has a spring piece (16) facing the conductive contact. The spring piece has plural finger pieces and is for elastically contacting with the connection object. The finger pieces are arranged to have a slit left between adjacent ones of the finger pieces. The insulator has a beam portion (19) placed in the slit.

10 Claims, 2 Drawing Sheets

CONNECTOR IN WHICH CONTACT FORCE CAN BE MAINTAINED DURING A LONG PERIOD

This application claims priority to prior Japanese patent application JP 2002-286663, the disclosure of which is incorporated herein by reference.

BACKGROUND OF THE INVENTION

The present invention relates to an electrical connector having, in addition to a signal contact, a ground plate for electrically connecting the ground in the manner known in the art.

Such a connector is usable, for example, in a liquid crystal display (LCD) monitor known in the art. The LCD monitor is provided with a circuit board on which a connector is mounted. The connector of the type is disclosed as a receptacle connector in, for example, JP-A 2001-203047.

The receptacle connector comprises a thin insulator, plural conductive signal contacts aligned in and held by the insulator, and a conductive ground plate held by the insulator to face the signal contacts. The ground plate has a part press-fitted into a holding hole made in the insulator. In the receptacle connector, each of the signal contacts and the ground plate serve as a spring member for generating contact force known in the art.

When the receptacle connector is connected to a connecting object, namely, a plug connector, the ground plate is elastically bent in a thickness direction of the insulator with an edge portion of the holding hole serving as a fulcrum for the ground plate. In this event, it is assumed that the ground plate causes the holding hole be enlarged in its radial direction. This results in decreasing the contact force relative to a predetermined value thereof.

SUMMARY OF THE INVENTION

It is therefore an abject of the present invention to provide a connector in which predetermined contact force can be maintained during a relatively long period.

Other objects of the present invention will become clear as the description proceeds.

According to an aspect of the present invention, there is provided a connector for connecting a connection object. The connector comprises an insulator, a conductive contact held by the insulator for electrically connecting the connection object, and a conductive plate held by the insulator. The conductive plate has a spring piece facing the conductive contact. The spring piece has plural finger pieces for elastically contacting with the connection object. The finger pieces are arranged to have a slit left between adjacent ones of the finger pieces. The insulator has a beam portion placed in the slit.

According to another aspect of the present invention, there is provided a connector to be connected to a connection object. The connector comprises an insulator, a first contact point, and a second contact point placed opposite to the first contact point. The d first contact point generates contact force towards the second contact point. The second contact point generates contact force towards the first contact point. The second contact point has branched portions. The insulator has a beam portion located between the branched portions.

DESCRIPTION OF THE PREFERRED EMBODIMENT

Figure 1:
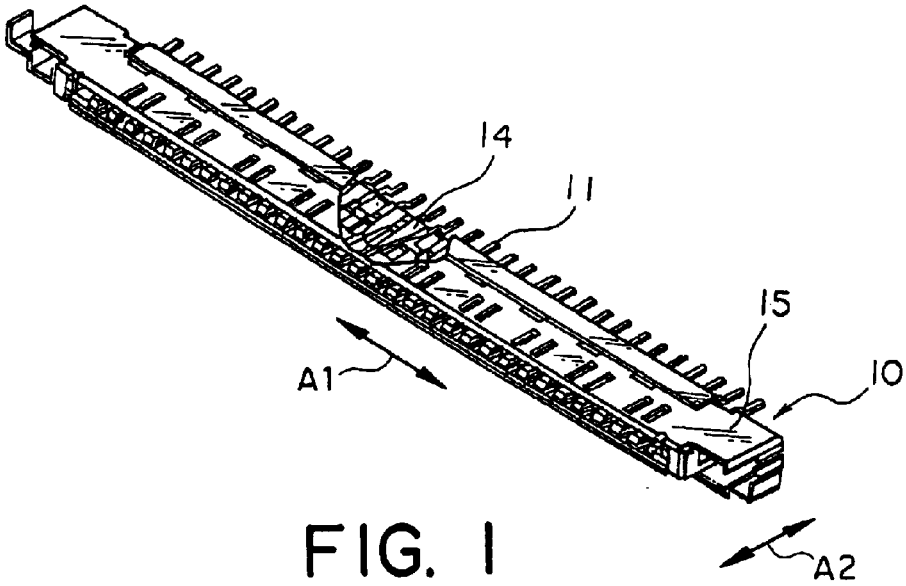
FIG. 1 is a perspective view of a receptacle connector as a connector according to an embodiment of the present invention.
Figure 2:
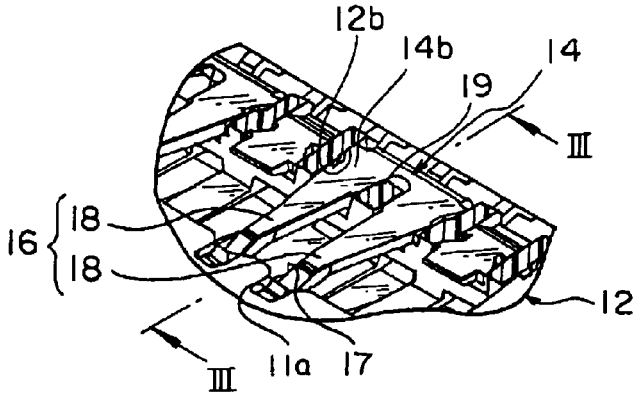
FIG. 2 is an enlarged perspective sectional view of a principal part of the connector of FIG. 1.
Figure 3:
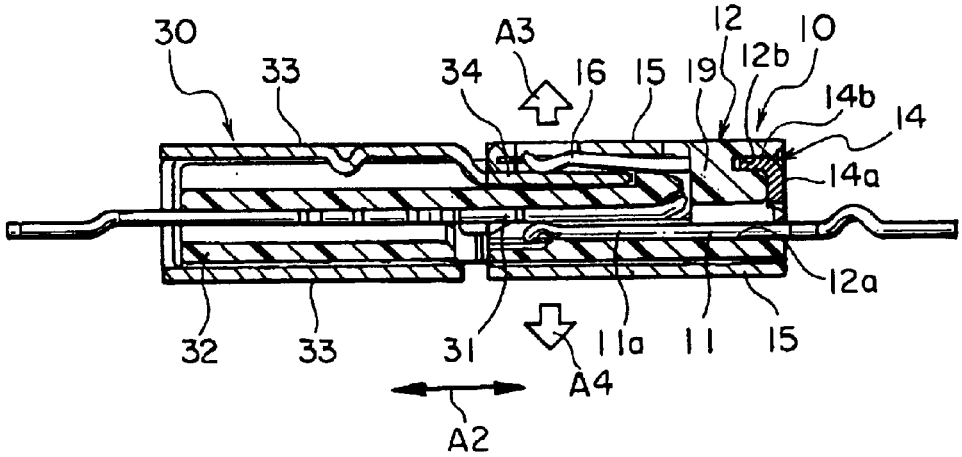
FIG. 3 shows, together with a plug connector, a sectional view taken along a line III—III of FIG. 2.

With reference to FIGS. 1–3, description will be made as regards a connector according to an embodiment of the present invention.

The shown connector is a receptacle connector 10 which will be mounted on a circuit board provided in an LCD monitor known in the art. The receptacle connector 10 is for electrically connecting with a conductive plug connector 30 as a connecting object. The plug connector 30 includes plural conductive signal contacts 31, an insulator 32 holding the signal contacts 31, a metal shell 33 covering the insulator 32, and a conductive ground contact 34 formed integral with the shell 33. The plug connector 30 may be a relay connector connected to a flexible printed card (FPC) or a fine line cable known in the art.

The receptacle connector 10 includes plural conductive signal contacts 11 for connecting with the signal contacts 31 of the plug connector 30, respectively, and an insulator 12 which is of a thin shape and fixedly holds the signal contacts 11. The signal contacts 11 are press-fitted into plural holding holes 12*a* made in a lower portion of the insulator 12, respectively. The signal contacts 11 are arranged in a first or horizontal longitudinal direction A1 and each is referred as a first contact point. Each of the signal contacts 11 has a spring piece 11*a* which extends substantially in a second direction A2 horizontal and perpendicular to the first direction A1. The spring piece 11*a* is for press-contacting with each of the signal contacts 31 of the plug connector 30.

Figure 4:
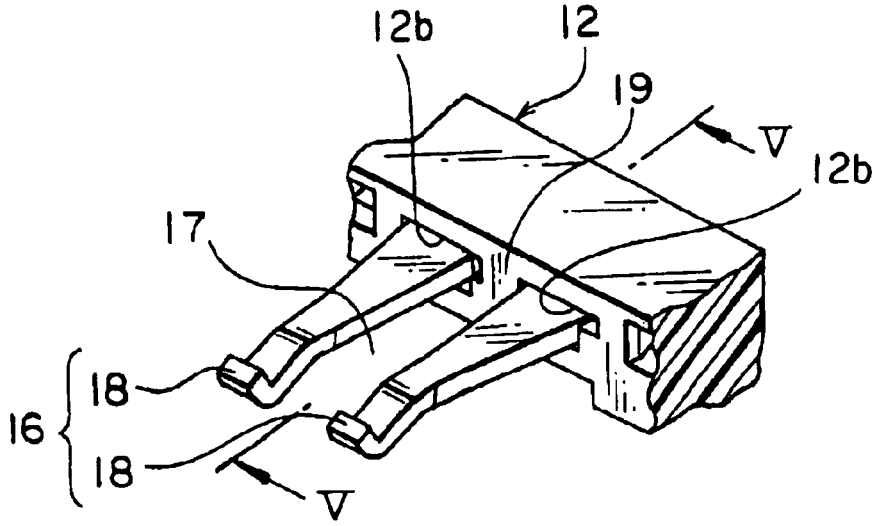
FIG. 4 is an enlarged perspective view showing a relation between an insulator and a ground plate included in the connector of FIG. 1.
Figure 5:
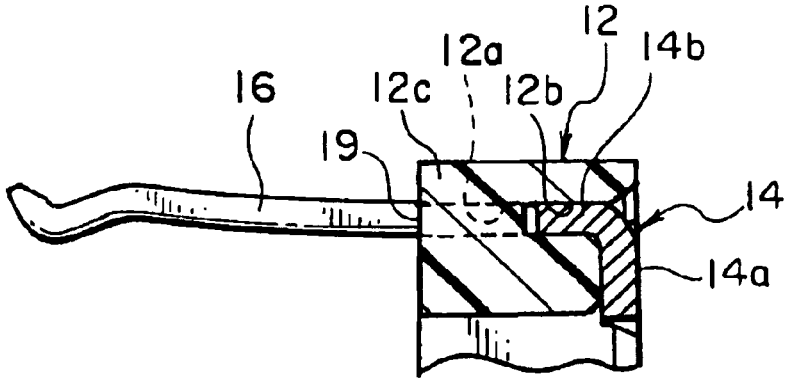
FIG. 5 is a sectional view taken along a line V—V of FIG. 4.

Referring to FIGS. 4 and 5 in addition, the receptacle connector 10 further includes a conductive ground plate 14 held by the insulator 12 and a metal shell 15 covering the insulator 12 from an outer side thereof. The ground plate 14 is in contact with the metal shell 15 and electrically connected to the ground. The ground plate 14 includes a base portion 14*a* extending along the insulator 12 in the first direction A1, plural press-fitting portions 14*b* protruded from the base portion 14*a* in the second direction A2 to be arranged in the first direction A1, and plural spring pieces 16 extending from the press-fitting portions 14*b* in the second direction A2, respectively. Each of the spring pieces 16 is of a branched shape to have a pair of finger pieces 18 parallel to each other with a slit 17 left therebetween. In other words, each of the spring pieces 16 is divided into plural branched portions, namely, two finger pieces 18 by the slit 17. Each of the finger pieces 18 has an elasticity or a spring nature. In this connection, each of finger pieces 18 extends substantially in the second direction A2 and is referred as a second contact point.

The press-fitting portions 14*b* are formed as a wide width portion and press-fitted into plural holding holes 12*b*, respectively, made in an upper portion of the insulator 12. Since the slit 17 extends into each of the press-fitting portions 14*b* towards the base portion 14*a*, this press-fitting between the press-fitting portions 14*b* and the plural holding holes 12*b* is favorably and elastically carried out.

On the other hand, the insulator 12 has plural beam portions 19 formed integral therewith to correspond to the spring pieces 16, respectively. More particularly, each of the beam portions 19 extends vertically within each of the holding holes 12*b* to have upper and lower ends connected to the insulator 12. Each of the beam portions 19 is inserted into the slit 17 in the vicinity of the press-fitting portions 14*b*. Namely, each of the beam portions 19 is positioned between the pair of finger pieces 18.

When the receptacle connector 10 is fitted to the plug connector 30 as illustrated in FIG. 3, spring portions 11*a* of the signal contacts 11 comes into elastic contact with the signal contacts 31, respectively. Therefore, the receptacle connector 10 and the plug connector 30 are electrically connected to each other.

Simultaneously, at least one of the spring pieces 16 comes into elastic contact with the ground contact 34. Therefore, the metal shell 33 of the plug connector 30 is electrically connected to the ground contact 34 in addition to the metal shell 15 of the receptacle connector 10. Whenever the receptacle connector 10 is fitted to the plug connector 30, each of the finger pieces 18 is moved with using, as a fulcrum, an edge portion of the holding hole 12*b*. More particularly, when the receptacle connector 10 is connected to the plug connector 30, the finger pieces 18 is moved upwardly by the ground contact 34 as shown by an up-directed arrow A3 in FIG. 3. On the other hand, the spring piece 11*a* is moved downwardly as shown by a down-directed arrow A4 in FIG. 3.

In this event, it can be avoided to cause the holding hole 12*a* of the insulator 12 be enlarged by movement of the finger pieces 18 even in a case where the insulator 12 is thin at a portion 12*c* above the ground plate 14. This is because the beam portion 19 integral with the insulator 12 is positioned between the finger pieces 18. With this structure, a decrease of contact force is prevented.

While the present invention has thus far been described in connection with a single embodiment thereof, it will readily be possible for those skilled in the art to put this invention into practice in various other manners. For example, although the connector has the plural spring pieces, it may be provided with a single spring piece. The number of slit may be two or more. In this event, the number of the finger pieces becomes three or more. Furthermore, the present invention is applicable to various connectors of the other types although it is described as regards the receptacle connector provided in the LCD monitor.

What is claimed is:

1. A connector for connecting a connection object, comprising:

an insulator having a pair of walls which are opposite to each other to define a holding hole therebetween;

a conductive contact held by said insulator for electrically connecting said connection object; and a conductive plate held by said insulator, said conductive plate having a spring piece facing said conductive contact, said spring piece having plural finger pieces for elastically contacting with said connection object, said finger pieces being arranged in said holding hole to have a slit left between adjacent ones of said finger pieces, each of said finger pieces extending outwardly of said holding hole, said insulator having a beam portion which is placed in said slit and connected between said walls.

2. The connector according to claim 1, wherein said conductive contact is used as a signal contact, said conductive plate being used a ground plate.

3. The connector according to claim 1, further comprising a metal shell covering said insulator and electrically connected to said conductive plate.

4. The connector according to claim 1, wherein said conductive plate further has a press-fitting portion which is press-fitted into said holding hole.

5. The connector according to claim 4, wherein said finger pieces extend from said press-fitting portion, said slit extending into said press-fitting portion.

6. The connector according to claim 5, wherein said beam portion is located in said holding hole to extend through said alit that is at said press-fitting portion.

7. The connector according to claim 1, wherein said beam portion is formed integral with said insulator.

8. The connector according to claim 1, wherein said spring piece is of a branched shape to form said finger pieces.

9. A connector to be connected to a connection object, comprising;

an insulator having a pair of walls which are opposite to each other to define a holding hole therebetween;

a first contact point; and a second contact point placed opposite to said first contact point, said first contact point generating contact force towards said second contact point, said second contact point generating contact force towards said first contact point, said second contact point having branched portions arranged in said holing hole, each of said branched portions extending outwardly of said holding hole, said insulator having a beam portion located between said branched portions and connected between said walls.

10. The connector according to claim 9, wherein said first contact point serves as a signal contact, said second contact point serving as a ground plate.

* * * * *

UNITED STATES PATENT AND TRADEMARK OFFICE

CERTIFICATE OF CORRECTION

PATENT NO. : 6,843,665 B2
DATED : January 18, 2005
INVENTOR(S) : Motojima et al.

It is certified that error appears in the above-identified patent and that said Letters Patent is hereby corrected as shown below:

Column 1,
Line 37, please change "abject" to -- object --.
Line 57, after the word "The," please delete the "d".

Column 4,
Line 27, please change "alit" to -- slit --.
Line 45, please change "holing" to -- holding --.
Line 47, after the word "portion," insert -- which is --.

Signed and Sealed this

Thirty-first Day of May, 2005

JON W. DUDAS
*Director of the United States Patent and Trademark Office*